US005242275A

United States Patent [19]

Terauchi et al.

[11] Patent Number: 5,242,275

[45] Date of Patent: Sep. 7, 1993

[54] SLANT PLATE TYPE REFRIGERANT COMPRESSOR WITH VARIABLE DISPLACEMENT MECHANISM

[75] Inventors: Kiyoshi Terauchi, Isesaki; Hitoshi Azami, Maebashi; Shizuyoshi Watanabe, Isesaki, all of Japan

[73] Assignee: Sanden Corporation, Gunma, Japan

[21] Appl. No.: 901,835

[22] Filed: Jun. 22, 1992

[51] Int. Cl.[5] ..... F04B 1/26

[52] U.S. Cl. ..... 417/222.2; 417/270

[58] Field of Search ..... 417/222.2, 222.1, 269, 417/270

[56] References Cited

U.S. PATENT DOCUMENTS 5,094,589 3/1992 Terauchi et al. ..... 417/270

*Primary Examiner*—Richard A. Bertsch
*Assistant Examiner*—Peter Korytnyk
*Attorney, Agent, or Firm*—Baker & Botts

[57] ABSTRACT

A slant plate type refrigerant compressor, such as a wobble plate type refrigerant compressor, with a capacity or displacement adjusting mechanism is disclosed. The capacity adjusting mechanism includes a valve device having an expandable/contractable bellows responsive to crank chamber pressure and a valve element fixedly attached to one end of the bellows to directly control the closing and opening of a passageway which connects a crank chamber and suction chamber. The bellows has a first effective pressure receiving cross-sectional area responsive to crank chamber pressure. The valve element has a second effective pressure receiving cross-sectional area responsive to suction chamber pressure. The second effective pressure receiving cross-sectional area of the valve element is approximately equal to or greater than 80% of the first effective pressure receiving cross-sectional area of the bellows so that the range of variation in the suction chamber pressure is sufficiently decreased during the capacity control stage of operation of the compressor, thereby controlling the air conditioning in a passenger compartment of an automobile in an efficient and effective manner.

5 Claims, 4 Drawing Sheets

SLANT PLATE TYPE REFRIGERANT COMPRESSOR WITH VARIABLE DISPLACEMENT MECHANISM

BACKGROUND OF THE INVENTION

1. Field of the Invention

The present invention relates to a refrigerant compressor, and more particularly, to a slant plate type refrigerant compressor, such as a wobble plate type refrigerant compressor, with a variable displacement mechanism suitable for use in an automotive air conditioning system.

2. Description of the Prior Art

A wobble plate type refrigerant compressor with a variable displacement mechanism as illustrated in FIG. 1 is disclosed in U.S. Pat. No. 4,960,367 to Terauchi. For purposes of explanation only, the left side of the Figure will be referenced as the forward end or front and the right side of the Figure will be reference as the rearward end.

Compressor 10 includes cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward of crank chamber 22 by a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for supporting drive shaft 26 by bearing 30 disposed in the opening 231. The inner end portion of drive shaft 26 is rotatably supported by bearing 31 disposed within central bore 210 of cylinder block 21. Bore 210, which extends to a rearward end surface of cylinder block 21, contains valve control mechanism 19' as discussed below.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which drive shaft 26 passes. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26.

Wobble plate 60 is rotatably mounted on slant plate 50 through bearings 61 and 62. Fork shaped slider 63 is attached to the outer peripheral end of wobble plate 60 and is slidably mounted on sliding rail 64 held between front end plate 23 and cylinder block 21. Fork shaped slider 63 prevents rotation of wobble plate 60 so that wobble plate 60 nutates along rail 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,001,029 to Shimizu.

Suction chamber 241 includes inlet portion **241*a* which is connected to an evaporator of the external cooling circuit (not shown). Discharge chamber 251 is provided with outlet portion 251*a* connected to a condenser of the cooling circuit (not shown). Gaskets 27 and 28 are located between cylinder block 21 and the front surface of valve plate 25, and the rear surface of valve plate 25 and rear end plate 24 respectively, to seal the mating surfaces of cylinder block 21, valve plate 25 and rear end plate 24**.

With reference to FIG. 2, valve control mechanism 19' includes cup-shaped casing member 191 defining valve chamber 192 therewithin. O-ring **19*a* is disposed between an outer surface of casing member 191 and an inner surface of bore 210 to seal the mating surfaces of casing member 191 and cylinder block 21. A plurality of holes 19*b* are formed at the closed end (to the left in FIGS. 1 and 2) of casing member 191 to expose valve chamber 192 to the crank chamber pressure through gap 31*a* existing between bearing 31 and cylinder block 21. Valve device 193, which has a longitudinally expandable and contractable bellows 193*a* and valve element 193*b* attached at a rearward end of bellows 193*a*, is disposed in valve chamber 192. Bellows 193*a* longitudinally contracts and expands in response to the crank chamber pressure. Bellows 193*a* is made of an elastic material, for example, phosphor bronze and has an effective pressure receiving cross-sectional area which is designated below as area $A_1$. Valve element 193*b* is generally hemispherical shaped and is attached at the rearward end of bellows 193*a*. Projection member 193*c*, which is attached at a forward end of bellows 193*a*, is secured to axial projection 19*c* formed at the center of the closed end of casing member 191. Bias spring 193*d* is longitudinally and compressedly disposed within an inner hollow space of bellows 193*a*. The resultant force F of the restoring force of bellows 193*a* and bias spring 193*d* continuously urges valve element 193*b* rearwardly (to the right in FIGS. 1 and 2**).

Cylinder member 194, which includes valve seat **194*a*, penetrates the center of valve plate assembly 200, which includes valve plate 25, gaskets 27, 28, suction reed valve 271 and discharge reed valve 281. Valve seat 194*a* is formed at a forward end of cylinder member 194 and is secured to an opened end of casing member 191. Nut 100 is screwed on cylinder member 194 from a rearward end of cylinder member 194 located in discharge chamber 251 to fix cylinder member 194 to valve plate assembly 200 with valve retainer 253. Conical-shaped opening 194*b*, which receives valve element 193*b*, is formed at valve seat 194*a* and is linked to cylinder 194*c* axially formed in cylinder member 194. Consequently, annular ridge 194*d* is formed at a location which is the boundary between conical-shaped opening 194*b* and cylinder 194*c***.

When bellows **193*a* expands to a certain longitudinal length, generally hemispherical-shaped valve element 193*b* is received by conical-shaped opening 194*b* to form a circular line contact 193*e* therebetween. Circular line contact 193*e* divides valve element 193*b* into front portion 193f and rear portion 193g, an exterior surface of which is responsive to pressure in suction chamber 241 conducted via later-mentioned radial hole 151, conduit 152 and hole 153. Rear portion 193g of valve element 193b has the effective pressure receiving cross-sectional area which is designated below as area $A_2$, and which is approximately 50% of the effective pressure receiving cross-sectional area $A_1$ of bellows 193a**.

Actuating rod 195, which is slidably disposed within cylinder 194c, slightly projects from the rearward end of cylinder 194c, and is linked to valve element 193b through bias spring 196, which smoothly transmits the force from actuating rod 195 to valve element 193b of valve device 193. Actuating rod 195 includes annular flange 195a which is integral with and radially extends from an outer surface of a front end portion of actuating rod 195. Annular flange 195a is located in conical shaped opening 194b, and prevents an excessive rearward movement of actuating rod 195 by contacting with annular ridge 194d. O-ring 197 is mounted about actuating rod 195 to seal the mating surfaces of cylinder 194c and actuating rod 195, thereby preventing the invasion of the refrigerant gas from discharge chamber 251 to conical shaped opening 194b via the gap created between cylinder 194c and rod 195. Cup-shaped member 103 having a threaded portion at its inner peripheral side wall is mounted on the rear end portion of cylinder member 194 to prevent O-ring 197 from falling off from the rear end of cylinder member 194.

Radial hole 151 is formed at valve seat 194a to link conical shaped opening 194b to conduit 152 formed in cylinder block 21. Conduit 152, which includes cavity 152a, is linked to suction chamber 241 through hole 153 formed at valve plate assembly 200. Passageway 150, which provides communication between crank chamber 22 and suction chamber 241, includes gap 31a, bore 210, holes 19b, valve chamber 192, conical shaped opening 194b, radial hole 151, conduit 152 and hole 153. As a result, the opening and closing of passageway 150 is controlled by the contraction and expansion of valve device 193 primarily in response to crank chamber pressure.

During operation of compressor 10, drive shaft 26 is rotated by the engine of the vehicle through an electromagnetic clutch 300. Cam rotor 40 is rotated with drive shaft 26, rotating slant plate 50 as well, which causes wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion 241a flows into each chamber 70 through suction ports 242 and then is compressed. The compressed refrigerant gas is discharged to discharge chamber 251 from each cylinder 70 through discharge ports 252, and therefrom into the cooling circuit through outlet 251a.

The capacity of compressor 10 is adjustable to maintain a constant pressure in suction chamber 241 in response to changes in the heat load on the evaporator or changes in the rotating speed of the compressor. Adjustment of the capacity of the compressor occurs by changing the angle of slant plate 50 which is dependent upon the crank chamber pressure. An increase in crank chamber pressure decreases the slant angle of slant plate 50 and wobble plate 60, decreasing the capacity of the compressor. A decrease in the crank chamber pressure increases the angle of slant plate 50 and wobble plate 60, increasing the capacity of the compressor.

As discussed in U.S. Pat. No. 4,960,367, the effect of valve control mechanism 19' is to maintain a constant pressure at the outlet of the evaporator by controlling the capacity of the compressor in the following manner. Actuating rod 195 pushes valve element 193b in the direction to contract bellows 193a and bias spring 196. Actuating rod 195 moves in response to pressure in discharge chamber 251. Accordingly, increasing pressure in discharge chamber 251 further moves rod 195 toward bellows 193a, thereby increasing the contraction of bellows 193a. As a result, the control point for changing the displacement of the compressor is shifted to maintain a constant pressure at the evaporator outlet. That is, valve control mechanism 19 makes use of the fact that the discharge pressure of the compressor is roughly directly proportional to the suction flow rate. Since actuating rod 195 moves in direct response to changes in discharge pressure, and applies a force directly to valve device 193, the control point at which valve device 193 operates is shifted in a direct and responsive manner by changes in discharge pressure.

Further operation of valve control mechanism 19' is described in detail below. In order to simplify the explanation of the operation of valve control mechanism 19', the above-mentioned effect of valve control mechanism 19' is neglected hereinafter.

With reference to FIGS. 3 and 4, and as particularly illustrated in FIG. 4, in a situation where operation of the compressor is stopped, the suction chamber pressure Ps and the crank chamber pressure Pc are in a state of equilibration, i.e., Pc=Ps, which is greater than the operating point $P_1'$ of valve device 193. This causes the contraction of bellows 193a so that valve element 193b permits communication between suction chamber 241 and valve chamber 192 through conical-shaped opening 194b, radial hole 151, conduit 152 and hole 153 to thereby establish communication between crank chamber 22 and suction chamber 241.

In one compressor operational situation indicated by time period "a" in FIG. 4, which is a so-called cool down stage, the compressor operates as follows. In the beginning of operation of the compressor, the communication between crank chamber 22 and suction chamber 241 is maintained, thereby satisfying the equation Pc=Ps as shown by the straight line "1" in FIG. 3 until the suction chamber pressure Ps falls to the operating point $P_1'$ of valve device 193. When the suction chamber pressure Ps falls to the operating point $P_1'$ of valve device 193, valve element 193b contacts an inner surface of conical-shaped opening 194b due to expansion of bellows 193a. If the suction chamber pressure Ps drops below the operating point $P_1'$ of valve device 193, valve element 193b frequently opens and closes conical-shaped opening 194b in accordance with the following equation:

$$F=(A_1-A_2)Pc+A_2 \cdot Ps \quad (1)$$

wherein F is the resultant force of the restoring forces of bellows 193a and bias spring 193d, $A_1$ is the effective pressure receiving cross-sectional area of bellows 193a, $A_2$ is the effective pressure receiving cross-sectional area of rear portion 193g of valve element 193b, Ps is the pressure in suction chamber 241, and Pc is the pressure in crank chamber 22. The above equation (1) can be converted into the following equation by solving for Pc:

$$PC=A_2 \cdot Ps/(A_2-A_1)+F/(A_1-A_2) \quad (2)$$

Equation (2) shows that the crank chamber pressure Pc varies in accordance with the changes in the suction chamber pressure Ps. Furthermore, in this prior art, $A_2$ is $0.5A_1$ so that equation (2) can be further converted to the following equation by substituting $0.5A_1$ for $A_2$.

$$Pc = -Ps + 2F/A_1 \quad (3)$$

Equation (3) is shown by the straight line "m" in FIG. 3. Therefore, suction chamber pressure Ps decreases in inverse proportion to the increase in the crank chamber pressure Pc with a proportion of one to one when the suction chamber pressure ps is less than the operating point $P_1'$ of valve device 193. At that time, the angular position of slant plate 50 is maintained at the maximum slant angle. However, as illustrated in FIG. 4, once the suction chamber pressure Ps reaches one predetermined pressure $P_5'$ at which the pressure difference between the crank and suction chambers 22 and 241 becomes ΔPmax, the angular position of slant plate 50 shifts to an angle which is smaller than its maximum slant angle. Therefore, the displacement of the compressor shifts to a value which is smaller than the maximum value.

Another compressor operational situation where the heat load on the evaporator gradually decreases is depicted by time period "b" in FIG. 4. As long as the angular position of slant plate 50 is maintained at one angle, suction chamber pressure Ps gradually decreases while the crank chamber pressure Pc gradually increases so as to satisfy equation (3). However, once the suction chamber pressure Ps reaches one predetermined pressure $P_5'$ the angular position of slant plate 50 shifts from one angle to another angle which is smaller than the first angle. Therefore, the displacement of the compressor shifts from one value to another value which is smaller than the first value. When the displacement of the compressor shifts to the smaller value due to the change in the angular position of slant plate 50 to a smaller angle, the suction chamber pressure Ps quickly increases because the newly decreased displacement of the compressor insufficiently compensates the heat load on the evaporator. However, this quick increase in the suction chamber pressure Ps hits a peak before the suction chamber pressure Ps reaches another predetermined pressure $P_4'$ at which the pressure difference between the crank and suction chambers 22 and 241 becomes ΔPmin. Thereafter, as long as the angular position of slant plate 50 is maintained at another angle, the suction chamber pressure Ps gradually decreases while the crank chamber pressure Pc gradually increases so as to satisfy equation (3). The above-described operation is repeated while the heat load on the evaporator gradually decreases in accordance with time.

On the other hand, in yet another compressor operation situation where heat load on the evaporator gradually increases in accordance with time, which is indicated by the period "c" in FIG. 4, as long as the angular position of slant plate 50 is maintained at one angle, the suction chamber pressure Ps gradually increases while the crank chamber pressure Pc gradually decreases so as to satisfy equation (3). However, once the suction chamber pressure Ps reaches another predetermined pressure $P_4'$, the angular position of slant plate 50 shifts from one angle to another angle which is greater than the first angle. Therefore, the displacement of the compressor shifts from one value to another value which is greater than the first value. When the displacement of the compressor shifts to the greater value due to the change in the angular position of slant plate 50 to a greater angle, the suction chamber pressure Ps quickly decreases because the newly increased displacement of the compressor sufficiently compensates the heat load on the evaporator. However, this quick decrease in the suction chamber pressure Ps bottoms out before the suction chamber pressure Ps reaches one predetermined pressure $P_5'$. Thereafter, as long as the angular position of slant plate 50 is maintained at one angle, the suction chamber pressure Ps gradually increases while the crank chamber pressure Pc gradually decreases so as to satisfy equation (3). The above-described operation is repeated while the heat load on the evaporator gradually increases in accordance with time.

Accordingly, during a capacity control stage of operation, which includes time periods "b" and "c" shown in FIG. 4, the suction chamber pressure Ps varies in a range $\Delta Ps' = P_4' - P_5'$ while the crank chamber pressure Pc varies in a range $\Delta Pc' = P_2' - P_3'$ Furthermore, the range of variation ΔPs' in the suction chamber pressure is equal to the range of variation ΔPc' in the crank chamber pressure because the suction chamber pressure Ps decreases in inverse proportion to the increase in the crank chamber pressure Pc at a proportion of one to one. Therefore, the range of variation ΔPs' in the suction chamber pressure during the capacity control stage is not negligible. Accordingly, when the prior art compressor is used in an automotive air conditioning system, the temperature of cooled air which leaves the evaporator varies over a range which is not negligible so that the air conditioning in a passenger compartment of an automobile is not effectively and efficiently controlled.

SUMMARY OF THE INVENTION

Accordingly, it is an object of this invention to provide a slant plate type refrigerant compressor having a capacity control mechanism which can sufficiently reduce the range of variation in the suction chamber pressure during a capacity control stage of operation.

In order to obtain the above object, the present invention provides a slant plate type refrigerant compressor including a compressor housing having a front end plate and a rear end plate. A crank chamber and a cylinder block are located in the housing, and a plurality of cylinders are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which couples the rotor to the pistons so that the rotary motion of the rotor is converted to reciprocating motion of the pistons. The coupling mechanism includes a member which has a surface disposed at an inclined angle relative to a plane perpendicular to the axis of the drive shaft. The inclined angle of the member is adjustable to vary the stroke length of the reciprocating pistons and thus vary the capacity or displacement of the compressor. The rear end plate surrounds a suction chamber and a discharge chamber. A passageway provides fluid communication between the crank chamber and the suction chamber. An angle contro device is supported in the compressor and controls the incline angle of the coupling mechanism member in response to changes in the crank chamber pressure.

The invention further provides a valve control mechanism which includes a longitudinally expandable and contractable bellows responsive to the crank chamber pressure and a valve element attached at one end of the bellows to open and close the above-described passageway. The bellows has a first effective pressure receiving cross-sectional area responsive to the crank chamber pressure. The passageway includes a valve seat formed therein for receiving the valve element. The valve element includes a boundary line which is defined at an exterior surface of the valve element when the valve element is received in the valve seat. The boundary line divides the valve element into a first portion having an exterior surface responsive to the suction chamber pressure when the valve element is received in the valve seat and a second portion which is the remainder of the valve element. The first portion of the valve element has a second effective pressure receiving cross-sectional area responsive to the suction chamber pressure. The second effective pressure receiving cross-sectional area is designed to be at least 80% of the first effective pressure receiving cross-sectional area to minimize the variation in the suction chamber pressure during the capacity control stage of operation of the compressor.

DETAILED DESCRIPTION OF THE PREFERRED EMBODIMENT

Figure 1:
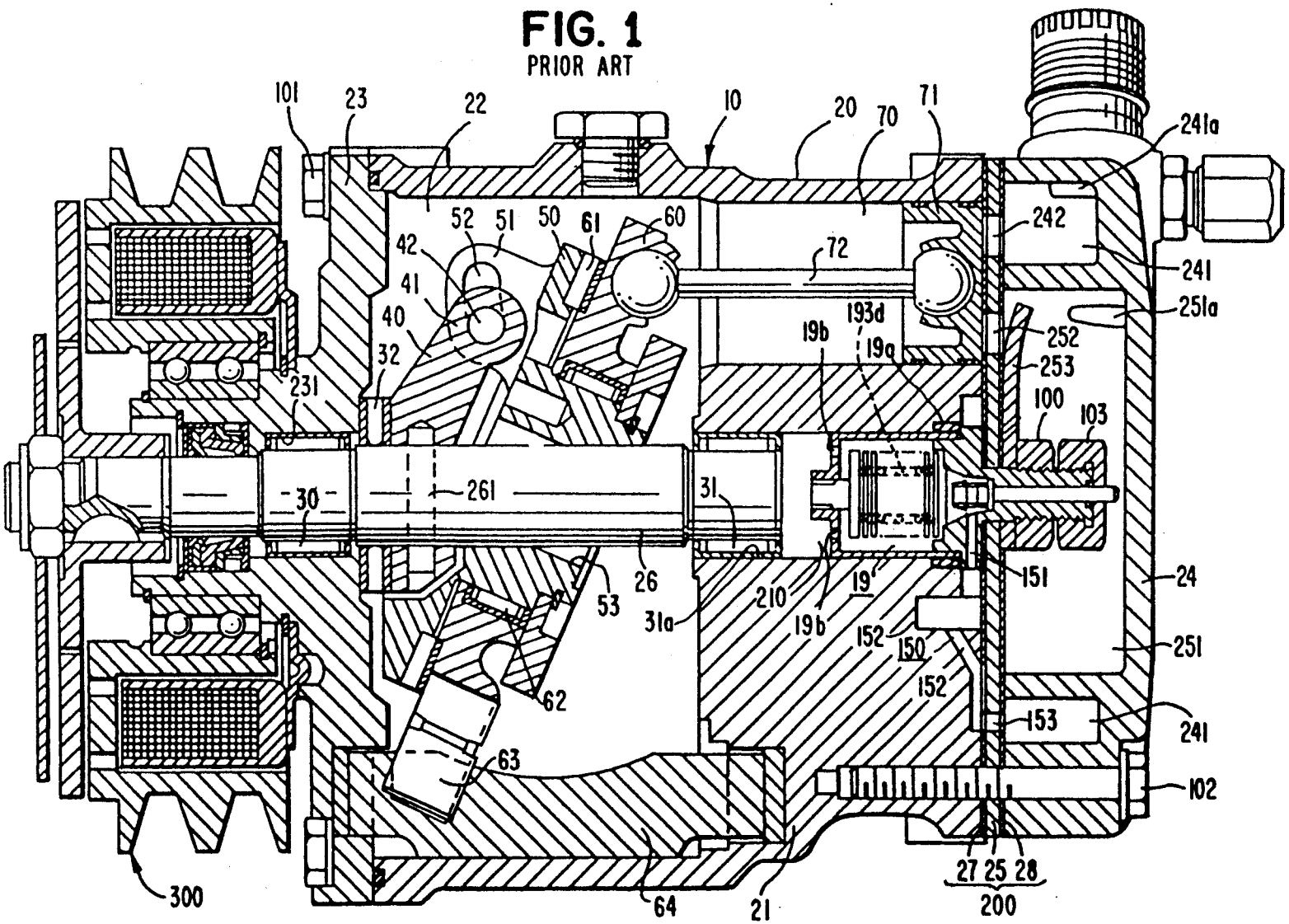
FIG. 1 PRIOR ART
FIG. 1 is a vertical longitudinal sectional view of a conventional wobble plate type refrigerant compressor with a variable displacement mechanism.
Figure 2:
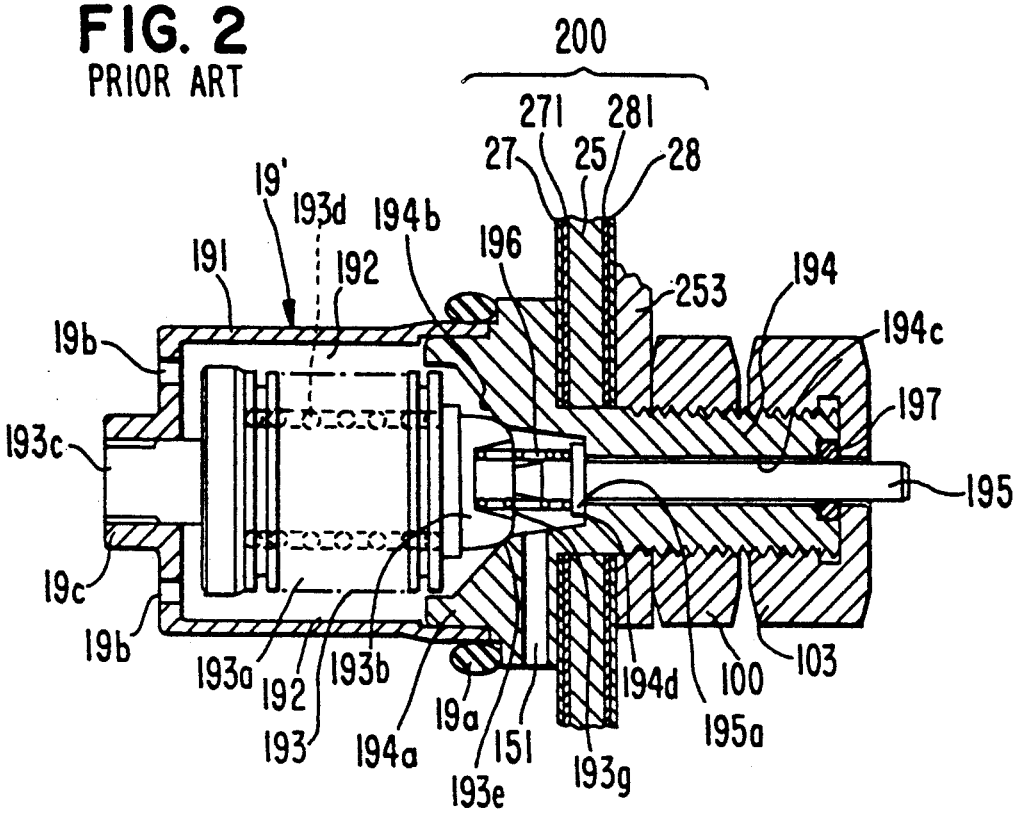
FIG. 2 PRIOR ART
FIG. 2 is an enlarged sectional view of a valve control mechanism shown in FIG. 1.
Figure 5:
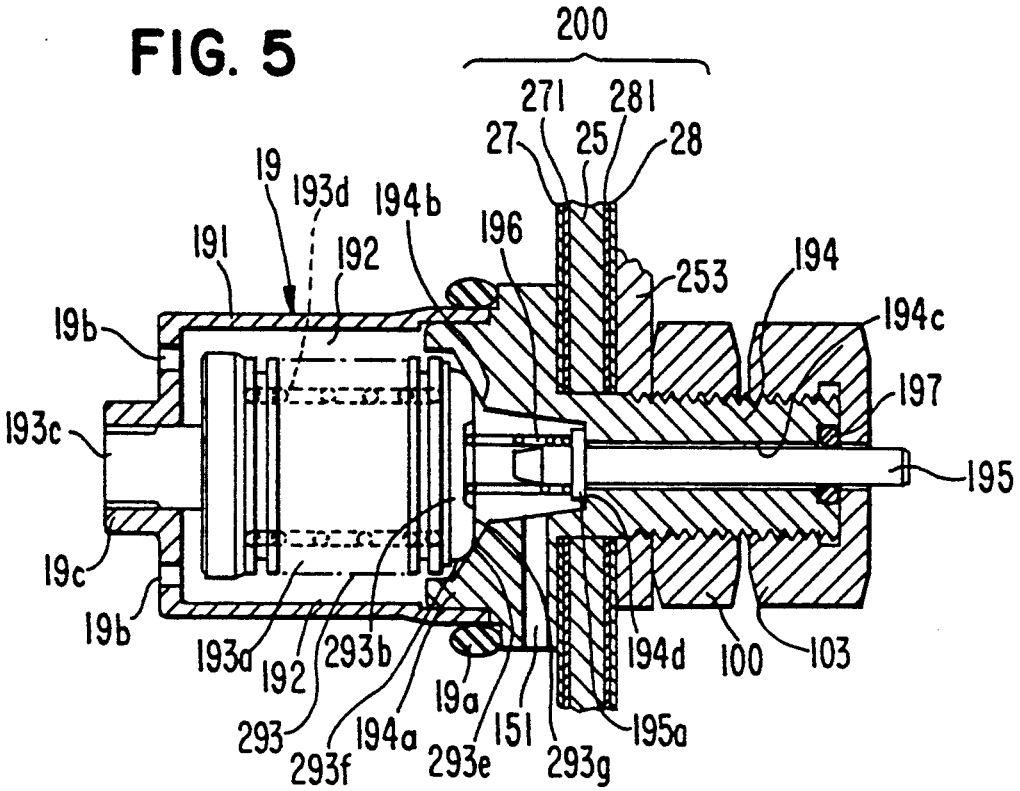
FIG. 5 is an enlarged sectional view of a valve control mechanism provided in a wobble plate type refrigerant compressor with a variable displacement mechanism in accordance with one embodiment of the present invention.
Figure 3:
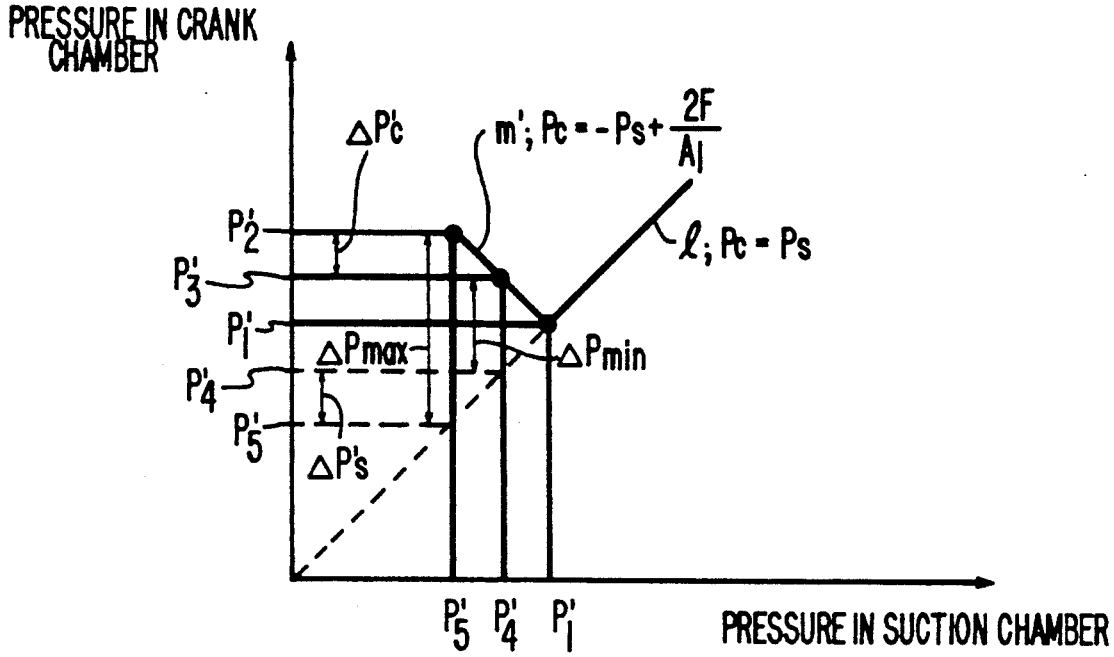
FIG. 3 PRIOR ART
FIG. 3 is a graph showing the relationship between the pressures in a crank chamber and a suction chamber of the wobble plate type refrigerant shown in FIG. 1.

FIG. 5 illustrates a construction of valve control mechanism 19 provided in a wobble plate type refrigerant compressor with a variable displacement mechanism in accordance with one embodiment of the present invention. In the drawing, the same numerals are used to denote the same elements shown in FIGS. 1 and 2. Furthermore, for purposes of explanation only, the left side of the Figure will be referred to as the forward end or front and the right side of the Figure will be referred to as the rearward end.

With reference to FIG. 5, valve control mechanism 19 includes valve device 293 having a longitudinally expandable and contractable bellows 193*a* and valve element 293*b* attached at a rearward end of bellows 193*a*. Bellows 193*a* longitudinally contracts and expands in response to crank chamber pressure. Bellows 193*a* is made of an elastic material, for example, phosphor bronze and has an effective pressure receiving cross-sectional area which is designated below as area $A_1$. Valve element 293*b* has a generally truncated cone shape and is attached at the rearward end of bellows 193*a*. Projection member 193*c*, which is attached at a forward end of bellows 193*a*, is secured to axial projection 19*c* formed at the center of the closed end of casing member 191. Bias spring 193*d* is longitudinally and compressedly disposed within an inner hollow space of bellows 193*a*. The resultant force F of the restoring forces of bellows 193*a* and bias spring 193*d* continuously urges valve element 293*b* rearwardly (to the right in FIG. 5).

When bellows 193*a* expands to a certain longitudinal length, generally truncated cone-shaped valve element 293*b* is received by conical-shaped opening 194*b* to form a circular line contact 293*e* therebetween. Circular line contact 293*e* divides valve element 293*b* into front portion 293*f* and rear portion 293*g*, an exterior surface of which is responsive to pressure in suction chamber 241 conducted via radial hole 151, conduit 152 and hole 153. Rear portion 293*g* of valve element 293*b* has an effective pressure receiving cross-sectional area which is designated below as area $A_2$, and which is approximately 80% of the effective pressure receiving cross-sectional area $A_1$ of bellows 193*a*.

Figure 6:
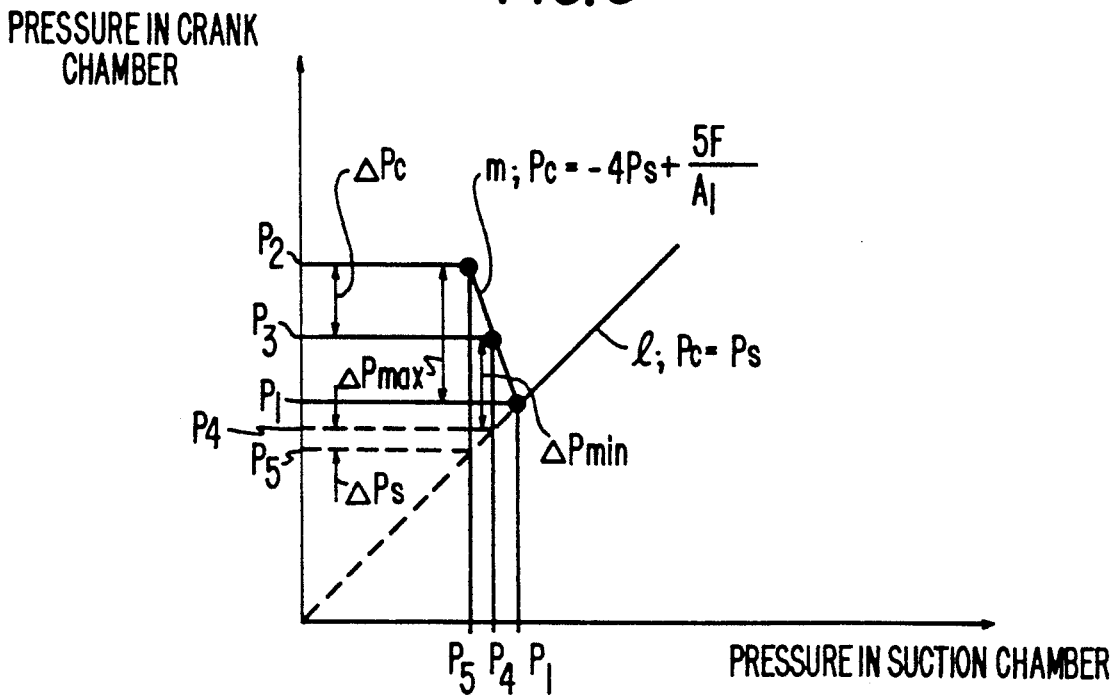
FIG. 6 is a graph showing the relationship between the pressures in a crank chamber and a suction chamber of the wobble plate type refrigerant compressor shown in FIG. 5.
Figure 4:
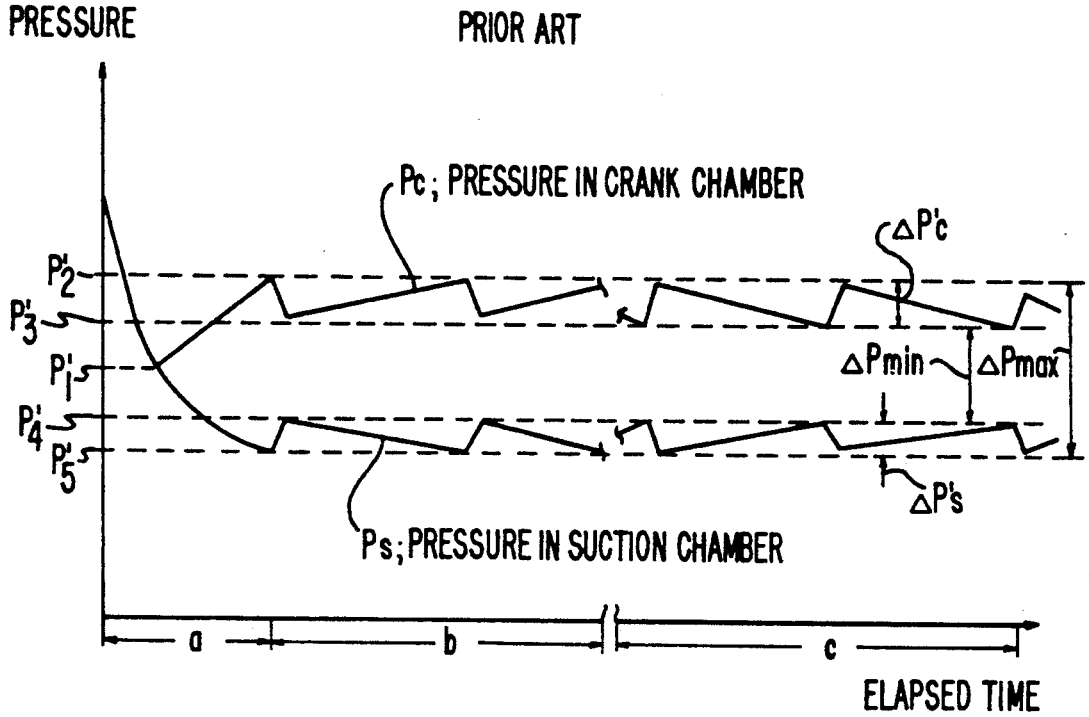
FIG. 4 PRIOR ART
FIG. 4 is a graph showing the relationship between the elapsed time and the pressures in the crank chamber and the suction chamber of the wobble plate type refrigerant compressor shown in FIG. 1.
Figure 7:
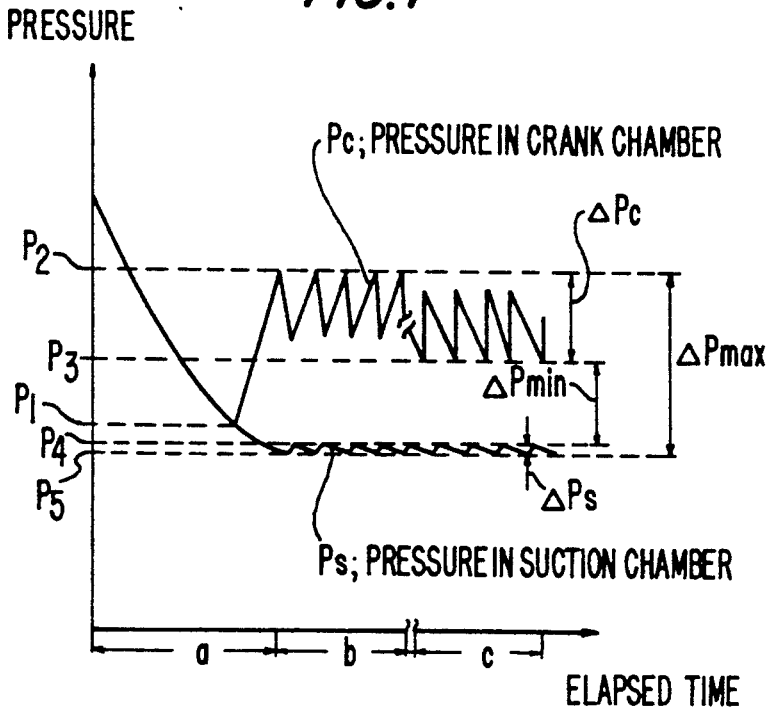
FIG. 7 is a graph showing the relationship between the elapsed time and the pressures in the crank chamber and the suction chamber of the wobble plate type refrigerant compressor shown in FIG. 5.

With reference to FIGS. 6 and 7, and as particularly illustrated in FIG. 7, in a situation where operation of the compressor is stopped, the suction chamber pressure Ps and the crank chamber pressure Pc are in a state of equilibration, i.e., Pc=Ps, which is greater than the operating point $P_1$ of valve device 293. This causes the contraction of bellows 193*a* so that valve element 293*b* permits communication between suction chamber 241 and valve chamber 192 through conical-shaped opening 194*b*, radial hole 151, conduit 152 and hole 153 to thereby establish communication between crank chamber 22 and suction chamber 241.

In one compressor operational situation indicated by time period "a" in FIG. 7, which is a so-called cool down stage, the compressor operates as follows. In the beginning of operation of the compressor, the communication between crank chamber 22 and suction chamber 241 is maintained, thereby satisfying the equation Pc=Ps as shown by the straight line "l" in FIG. 6 until the suction chamber pressure Ps falls to the operating point $P_1$ of valve device 293. When the suction chamber pressure Ps falls to the operating point $P_1$ of valve device 293, valve element 293*b* contacts an inner surface of conical-shaped opening 194*b* due to expansion of bellows 193*a*. If the suction chamber pressure Ps drops below the operating point $P_1$ of valve device 293, valve element 293*b* frequently opens and closes conical-shaped opening 194*b* in accordance with the following equation:

$$F=(A_1-A_2)Pc+A_2\cdot Ps \quad (1)$$

wherein F is the resultant force of the restoring forces of bellows 193*a* and bias spring 193*d*, $A_1$ is the effective pressure receiving cross-sectional area of bellows 193*a*, $A_2$ is the effective pressure receiving cross-sectional area of rear portion 293*g* of valve element 293*b*, Ps is the pressure in suction chamber 241, and Pc is the pressure in crank chamber 22. The above equation (1) can be converted into the following equation by solving for Pc:

$$Pc = A_2 \cdot Ps/(A_2 - A_1) + F/(A_1 - A_2) \quad (2)$$

Equation (2) shows that the crank chamber pressure Pc varies in accordance with the changes in the suction chamber pressure Ps. Furthermore, in this valve control mechanism, $A_2$ is $0.8A_1$ so that equation (2) can be further converted to the following equation by substituting $0.8A_1$ for $A_2$.

$$Pc = -4Ps + 5F/A_1 \quad (4)$$

Equation (4) is shown by the straight line "m" in FIG. 6. Therefore, the suction chamber pressure Ps decreases in inverse proportion to the increase in the crank chamber pressure Pc with a proportion of one to four when the suction chamber pressure Ps is less than the operating point $P_1$ of valve device 293. At that time, the angular position of slant plate 50 is maintained at the maximum slant angle. However, as illustrated in FIG. 7, once the suction chamber pressure Ps reaches one predetermined pressure $P_5$ at which the pressure difference between the crank and suction chambers 22 and 241 becomes ΔPmax, the angular position of slant plate 50 shifts to an angle which is smaller than the maximum slant angle. Therefore, the displacement of the compressor shifts to a value which is smaller than its maximum value.

Another compressor operational situation where the heat load on the evaporator gradually decreases is depicted by time period "b" in FIG. 7. As long as the angular position of slant plate 50 is maintained at one angle, the suction chamber pressure Ps gradually decreases while the crank chamber pressure Pc quickly increases so as to satisfy equation (4). However, once the suction chamber pressure Ps reaches one predetermined pressure $P_5$, the angular position of slant plate 50 shifts from one angle to another angle which is smaller than the first angle. Therefore, the displacement of the compressor shifts from one value to another value which is smaller than the first value. When the displacement of the compressor shifts to the smaller value due to the change in the angular position of slant plate 50 to a smaller angle, the suction chamber pressure Ps quickly increases because the newly decreased displacement of the compressor insufficiently compensates the heat load on the evaporator. However, this quick increase in the suction chamber pressure Ps hits a peak before the suction chamber pressure Ps reaches another predetermined pressure $P_4$ at which the pressure difference between the crank and suction chambers 22 and 241 becomes ΔPmin. Thereafter, as long as the angular position of slant plate 50 is maintained at another angle, the suction chamber pressure Ps gradually decreases while the crank chamber pressure Pc quickly increases so as to satisfy equation (4). The above-described operation is repeated while the heat load on the evaporator gradually decreases in accordance with time.

On the other hand, in yet another compressor operation situation where heat load on the evaporator gradually increases in accordance with time, which is indicated by the period "c" in FIG. 7, as long as the angular position of slant plate 50 is maintained at one angle, the suction chamber pressure Ps gradually increases while the crank chamber pressure Pc quickly decreases so as to satisfy equation (4). However, once the suction chamber pressure Ps reaches another predetermined pressure $P_4$, the angular position of slant plate 50 shifts from one angle to another angle which is greater than the first angle. Therefore, the displacement of the compressor shifts from one value to another value which is greater than the first value. When the displacement of the compressor shifts to the greater value due to the change in the angular position of slant plate 50 to a greater angle, the suction chamber pressure Ps quickly decreases because the newly increased displacement of the compressor sufficiently compensates the heat load on the evaporator. However, this quick decrease in the suction chamber pressure Ps bottoms out before the suction chamber pressure Ps reaches one predetermined pressure $P_5$. Thereafter, as long as the angular position of slant plate 50 is maintained at one angle, the suction chamber pressure Ps gradually increases while the crank chamber pressure Pc quickly decreases so as to satisfy equation (4). The above-described operation is repeated while the heat load on the evaporator gradually increases in accordance with time.

Accordingly, during a capacity control stage of operation, which includes time periods "b" and "c" shown in FIG. 7, in the compressor of the preferred embodiment, the suction chamber pressure Ps varies in a range $\Delta Ps = P_4 - P_5$ while the crank chamber pressure Pc varies in a range $\Delta Pc = P_2 - P_3$. Furthermore, the range of variation ΔPs in the suction chamber pressure is one-fourth the range of variation ΔPc in the crank chamber pressure because the suction chamber pressure Ps decreases in inverse proportion to the increase in the crank chamber pressure Pc with a proportion of one to four. For example, experimental data comparing conventional compressors and the compressor of the present invention shows that the range of variation in the suction chamber pressure during the capacity control stage decreases from 0.26 to 0.1 kgf/cm$^2$G. Therefore, in the compressor of the present invention, the range of variation in the suction chamber pressure during the capacity control stage can be effectively decreased by a significant amount as compared with conventional compressors. Accordingly, when the present invention compressor is used in an automotive air conditioning system, the temperature of cooled air which leaves the evaporator varies over a range which is negligible so that the air conditioning in a passenger compartment of an automobile can be effectively and efficiently controlled.

This invention has been described in detail in connection with the preferred embodiment. This embodiment, however, is merely for example only and the invention is not restricted thereto. It will be understood by those skilled in the art that other variations and modifications can be easily be made within the scope of this invention as defined by the claims.

We claim:

1. A slant plate type refrigerant compressor comprising a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface connected to said rotor and having an adjustable slant angle with respect to a plane perpendicular to the axis of said drive shaft, and coupling means for operationally coupling said slant plate to said pistons such that rotation of said drive shaft, rotor and slant plate reciprocates said pistons in said cylinders, the slant angle changing in response to a change in pressure in said crank chamber to thereby change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expandable and contractable bellows primarily responsive to pressure in said crank chamber and a valve element attached at one end of said bellows to open and close said passageway, said bellows having a first effective pressure receiving cross-sectional area responsive to pressure in said crank chamber, said passageway including a valve seat formed therein for receiving said valve element, said valve element including a boundary line which is defined at an exterior surface of said valve element when said valve element is received in said valve seat, said boundary line dividing said valve element into first and second portions, said first portion having an exterior surface responsive to pressure in said suction chamber when said valve element is received in said valve seat, said first portion of said valve element having a second effective pressure receiving cross-sectional area responsive to pressure in said suction chamber, said second effective pressure receiving cross-sectional area being approximately equal to or greater than 80% of said first effective pressure receiving cross-sectional area.

2. An adjustable slant plate type refrigerant compressor comprising:

a compressor housing provided with a plurality of cylinders, a suction chamber, a discharge chamber and an enclosed crank chamber;

a piston slidably fitted within each of said cylinders;

a drive mechanism including a rotor;

an adjustable slant plate having an inclined surface adjustably connected to said rotor and having an adjustable slant angle, the slant angle changing in response to a change in pressure in said crank chamber to thereby change the capacity of said compressor;

coupling means for operationally coupling said slant plate to said pistons such that rotation of said rotor and slant plate reciprocates said pistons in said cylinders;

a passageway in said compressor housing linking said suction chamber with said crank chamber; and a valve control means for controlling the opening and closing of said passageway, said valve control means including a bellows having a first effective pressure receiving cross-sectional area responsive to crank chamber pressure and a valve element attached at one end of said bellows to open and close said passageway, said passageway including a valve seat formed therein for receiving said valve element, said valve element including a boundary line which is defined at an exterior surface of said valve element when said valve element is received in said valve seat, said boundary line dividing said valve element into first and second portions, said first portion having an exterior surface responsive to pressure in said suction chamber when said valve element is received in said valve seat, said first portion of said valve element having a second effective pressure receiving cross-sectional area which is approximately equal to or greater than eighty percent of said first effective pressure receiving cross-sectional area.

3. The slant plate control mechanism of claim 2 wherein said valve element is frusto-conical and engages said valve seat along a circular line.

4. A slant plate control mechanism for use in controlling the angular position of an adjustable slant plate in a slant plate refrigerant compressor in response to crank chamber pressure, said compressor including a compressor housing defining a crank chamber and a suction chamber, said slant plate control mechanism comprising:

a passageway in said compressor housing connecting said crank and suction chambers;

a valve seat encircling said passageway;

a valve element engageable with said valve seat to close said passageway, a boundary between said valve element and said passageway defining a first effective pressure area on said valve element when said valve element engages said valve seat; and a bellows connected with said valve element for moving said valve element into engagement with said valve seat, the cross-sectional area of said bellows defining a second effective pressure area, said first effective pressure area on said valve element being approximately eighty percent or more of the second effective pressure area on said bellows.

5. The slant plate control mechanism of claim 4 also including a spring member within said bellows urging said valve element towards said seat.

* * * * *